United States Patent [19]

Bieberbach

[11] 4,266,600

[45] May 12, 1981

[54] HEAT EXCHANGER WITH DOUBLE WALLED TUBES

[75] Inventor: George Bieberbach, Tampa, Fla.

[73] Assignee: Westinghouse Electric Corp., Pittsburgh, Pa.

[21] Appl. No.: 35,870

[22] Filed: May 3, 1979

Related U.S. Application Data

[63] Continuation of Ser. No. 810,691, Jun. 28, 1977, abandoned.

[51] Int. Cl.[3] ..... F28P 7/00

[52] U.S. Cl. ..... 165/76; 165/83

[58] Field of Search ..... 165/81–83, 165/192, 160, 76

[56] References Cited

U.S. PATENT DOCUMENTS

| | | | |
|---|---|---|---|
| 1,134,324 | 4/1915 | Fisher | 165/83 |
| 1,720,912 | 7/1929 | McCabe et al. | 165/83 |
| 1,979,751 | 11/1934 | Leach | 165/160 |
| 2,825,463 | 3/1958 | Thomas | 165/83 |
| 3,820,598 | 6/1974 | Fenger et al. | 165/160 |
| 3,868,994 | 3/1975 | Petrek | 165/142 |

*Primary Examiner*—Samuel Scott
*Assistant Examiner*—Theophil W. Streule
*Attorney, Agent, or Firm*—F. J. Baehr, Jr.

[57] ABSTRACT

A plurality of double walled tubes are so disposed between a pair of spaced apart tube sheets so that the outer wall terminates adjacent one tube sheet and the inner wall terminates adjacent the other tube sheet and a shell portion enclosing the space between the tube sheets is removably attached to the tube sheets.

3 Claims, 1 Drawing Figure

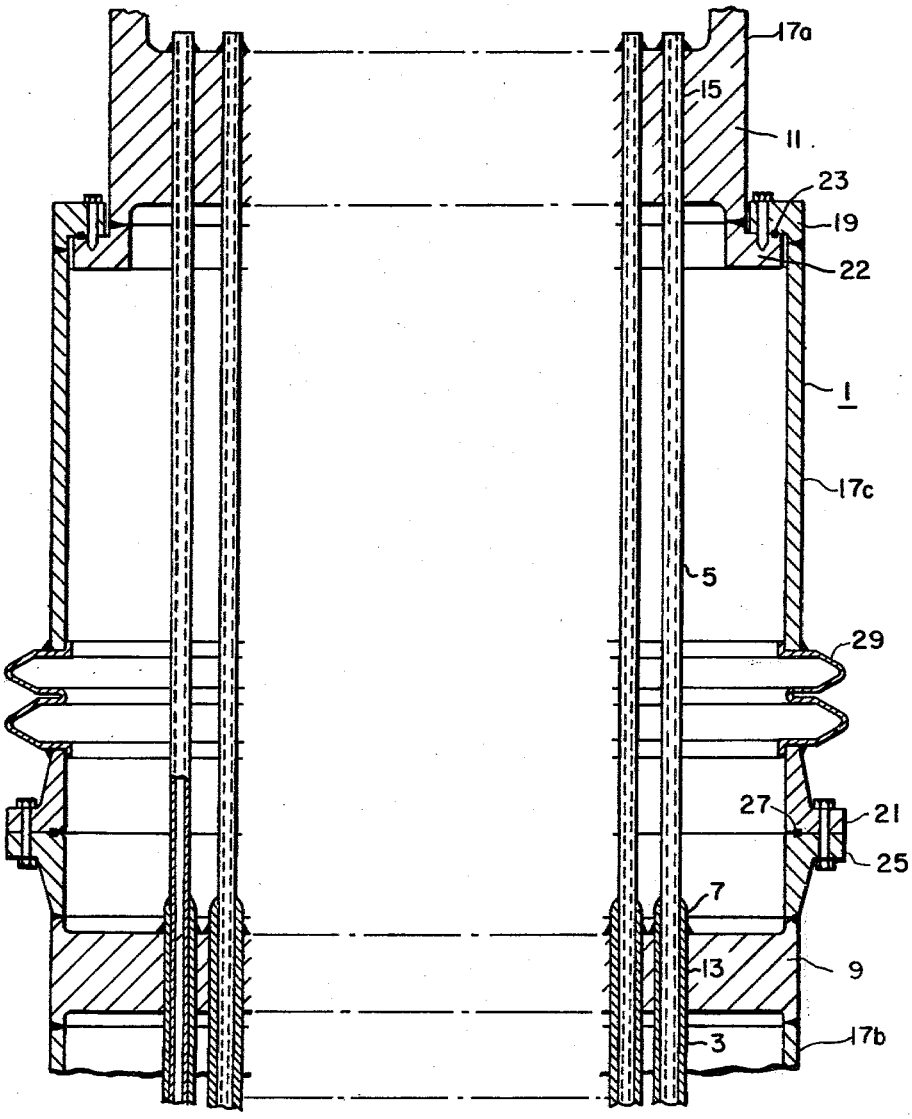
17a
15
11
23
19
22
1
17c
5
29
27
21
25
7
13
9
3
17b

HEAT EXCHANGER WITH DOUBLE WALLED TUBES

This is a continuation of application Ser. No. 810,691, filed June 28, 1977 now abandoned.

BACKGROUND OF THE INVENTION

This invention relates to heat exchangers and more particularly to heat exchangers utilizing double walled tubes to reduce the possibility of contact between the heating and the heated fluid.

It is normally desirable to separate heating and heated fluid in a heat exchanger and depending on the compatibility of the fluids the effort and expense expended to insure separation varies. Double walled tubes with grooves in one of the contacting walls have been proposed to be highly reliable. However, the tube to tube sheet joints are an area where the probability of leakage is high even when spaced apart tube sheets are utilized and the inner wall of the tube is seal welded to one tube sheet and the other wall is seal welded to the other tube sheet so that the space between the tube sheets should be readily available for inspection and/or repair.

SUMMARY OF THE INVENTION

In general, a heat exchanger, when made in accordance with this invention, comprises a plurality of double walled tubes having an inner wall engagingly disposed within an outer wall and a pair of tube sheets disposed in a spaced relationship adjacent one end of the tubes forming an inner and outer tube sheet with a space therebetween. The tube extend through the tube sheet so that the outer wall of the tube terminates adjacent the inner tube sheet and the inner wall of the tube terminates adjacent the outer tube sheet. The heat exchanger also comprises a removable shell portion disposed to cooperate with the tube sheets to enclose the space therebetween. A bellows is disposed in the shell portion to provide for differential expansion between the shell portion and the inner wall of the tubes.

BRIEF DESCRIPTION OF THE DRAWINGS

The objects and advantages of this invention will become more apparent from reading the following detailed description in connection with the accompanying drawing, in which:

The sole FIGURE is a partial sectional view of a heat exchanger made in accordance with this invention.

DESCRIPTION OF THE PREFERRED EMBODIMENT

Referring now to the drawing in detail, there is shown a portion of a heat exchanger 1 having a plurality of double walled tubes 3 disposed therein. The double walled tubes are made up of an inner wall 5 engagingly disposed within an outer wall 7. A pair of tube sheets 9 and 11 are disposed generally parallel to each other in a spaced relationship adjacent one end of the tubes 3. The tubes 3 pass through holes 13 and 15 in the tube sheets 9 and 11, respectively, and are so arranged with respect thereto that the ends of the outer walls 7 terminate adjacent the inner tube sheet 9 and are seal welded thereto and the ends of the inner walls 5 terminate adjacent the outer tube sheet 11 and are seal welded thereto.

As shown in the drawings the heat exchanger has a shell 17 made up of three portions, a first shell portion 17*a*, a second shell portion 17*b*, and an intermediate shell portion 17*c* disposed between the first and second shell portions 17*a* and 17*b*, respectively. The intermediate portion of the shell 17*c* is cooperatively associated with the tube sheets 9 and 11 so as to enclose the space therebetween and be removably connected thereto. The intermediate portion of the shell 17*c* is flanged at each end. One end has a flange 19 which extends radially inwardly from the intermediate portion of the shell 17*c* and the other end has a flange 21 which extends radially outwardly from the intermediate portion of the shell 17*c*.

The inwardly extending flange 19 disposed on the intermediate shell portion 17*c* cooperates with an outwardly extending flange 22 which is disposed on the first shell portion 17*a*. The flange 22 is also welded to the head 11 and a gasket 23 is disposed between the flanges 19 and 22 to form a seal therebetween. The outwardly extending flange 21 disposed on the intermediate shell portion 17*c*, cooperates with an outwardly extending flange 25 disposed on the shell portion 14*b* have a seal ring 27 disposed therebetween to form a seal.

The inwardly and outwardly extending flanges 19 and 22 together with forming the intermediate shell portion 17*c* so that its inner surface is larger than the outer periphery of the flange 22 allow the shell portion 17 to be removed from the heat exchanger.

The intermediate shell portion 17*c* has a bellows 29 or other expansion means disposed therein to allow for differential expansion between the inner wall 5 of the tube 3 and the intermediate shell portion 17*c*. The bellows 29 also compensates for any misalignment between the flanges and assists in aligning the flanges when installing the intermediate shell portion 17*c*.

The apparatus hereinbefore described advantageously provides a removable intermediate shell portion 17*c* for allowing access to the welds between the outer wall 7 and the inner tube sheet 9; provides for differential expansion between the inner wall 5 of the tubes 3 and the intermediate shell portion 17*c*; and provides for accommodating misalignment within the flanges 19 and 22 and 21 and 25.

What is claimed is:

1. A heat exchanger shell comprising:

a first shell portion having an outwardly extending flange on one end thereof;

a second shell portion having an outwardly extending flange on one end thereof;

an intermediate shell portion disposed between said first and second shell portion;

said intermediate shell portion having an inwardly extending flange on one end thereof and an outwardly extending flange on the other end thereof;

said intermediate shell portion having an internal surface which is slightly larger than the outer periphery of said flange on said first shell portion; and said flanges on said intermediate shell portion mating with said flanges on said first and second shell portion and being so disposed with respect thereto so that the intermediate shell portion can slide over the first shell portion.

2. A heat exchanger as set forth in claim 1 and further comprising means for providing for thermal expansion disposed in the intermediate portion of the shell.

3. A heat exchanger shell as set forth in claim 2 wherein the means for providing for thermal expansion is a bellows.

* * * * *